United States Patent [19]

Wang et al.

[11] Patent Number: 4,497,669

[45] Date of Patent: Feb. 5, 1985

[54] PROCESS FOR MAKING ALLOYS HAVING COARSE, ELONGATED GRAIN STRUCTURE

[75] Inventors: Kathy K. Wang, Suffern; Mark L. Robinson, Warwick, both of N.Y.

[73] Assignee: Inco Alloys International, Inc., Huntington, W. Va.

[21] Appl. No.: 516,109

[22] Filed: Jul. 22, 1983

[51] Int. Cl.[3] ..... C21D 00/00

[52] U.S. Cl. ..... 148/11.5P; 75/232; 75/235; 75/246; 75/247

[58] Field of Search ..... 148/11.5 P, 11.5 N, 148/11.5 F; 75/0.5 C, 232, 235, 246, 247

[56] References Cited

U.S. PATENT DOCUMENTS 3,639,179 2/1972 Reichman et al. ..... 148/11.5 P
3,655,458 4/1972 Reichman et al. ..... 148/11.5 P
4,226,644 10/1980 Cox et al. .

OTHER PUBLICATIONS

"The Mechanical Properties of RSR Processed Fe-Si-Al alloys" by S. Thamboo, G. W. Powell and J. P. Hirth, *The International Journal of Powder Metallurgy & Powder Technology*, vol. 19, No. 3, pp. 211-221.

*Primary Examiner*—W. Stallard
*Attorney, Agent, or Firm*—Raymond J. Kenny; Edward A. Steen

[57] ABSTRACT

An alloy made by water atomizing the charge component into powder, extruding the powder, hot rolling the powder and heat treating the product. The alloy displays superior stress rupture characteristics when compared to a corresponding conventionally wrought alloy.

28 Claims, 4 Drawing Figures

PROCESS FOR MAKING ALLOYS HAVING COARSE, ELONGATED GRAIN STRUCTURE

TECHNICAL FIELD

The instant invention relates to alloys in general and more particularly to an atomized powder metallurgy (P/M) process for producing high temperature alloys having coarse, elongated grain structure. The strength and rupture characteristics of the resulting alloys are superior to similar conventionally wrought alloys.

BACKGROUND ART

Superalloys and heat resistant alloys are materials that exhibit superior mechanical and chemical attack resistance properties at elevated temperatures. Typically they include, as their main constituents, nickel, cobalt, and iron, either singly or in combinations thereof. In addition, other elements such as chromium, manganese, aluminum, titanium, silicon, molybdenum, etc., are added to improve the strength, corrosion resistance and oxidation resistance characteristics of the alloy. Inasmuch as these alloys are utilized in hot environments such as gas turbines, heat exchangers, furnace components, petrochemical installations, etc., their superior characteristics serve them well.

The properties of such alloys are strongly affected by their grain size. At relatively low temperatures, smaller grain sizes are acceptable. However, at higher temperatures (>871.1° C. or 1600° F.) creep is usually observed to occur much more rapidly in fine grain materials than in coarse grain materials. Accordingly, coarse grained materials are usually preferred for stressed applications at elevated temperatures. It is believed that failure generally occurs at the grain boundaries oriented perpendicular to the direction of the applied stress.

One method used in improving the creep properties of an alloy is to attempt to elongate the grains. By elongating the grains, there are relatively fewer grain boundaries transverse to the stress axis. Moreover, longer elongated grain boundaries appear to improve the temperature characteristics of the alloy.

Oxide dispersion strengthened alloys made by mechanical alloying techniques exhibit superior high temperature rupture strength due to the presence of stable oxide particles in a coarse and highly elongated grain matrix.

However, depending on the circumstances, mechanically alloyed products may not always be required. Lower cost alloys, with intermediate properties (falling between wrought alloys and mechanical alloys) may be acceptable. Accordingly, it was believed that lower cost powder metallurgy alloys having intermediate properties could be produced by controlling the composition and oxide content (such as $Al_2O_3$ and $Y_2O_3$) of atomized powders and applying suitable thermomechanical processing (TMP) steps to generate an alloy having a coarse, elongated grain structure.

SUMMARY OF THE INVENTION

The selected elements are water atomized, extruded, hot rolled, cold rolled (if desired) and annealed. The resulting alloy, having a coarse, elongated grain structure, exhibits greater stress rupture life characteristics than that shown by a conventionally wrought alloy. The invention relates to heat resistant alloys and superalloys.

PREFERRED MODE FOR CARRYING OUT THE INVENTION

For the purposes of this disclosure, an alloy having a coarse, elongated structure is defined as an alloy having a grain aspect ratio greater than 1:1 and preferably greater than 10:1. Additionally, the alloy will exhibit about 2–6 grains across a 6.4 mm (0.25 inch) longitudinal section of plate.

Figure 1:
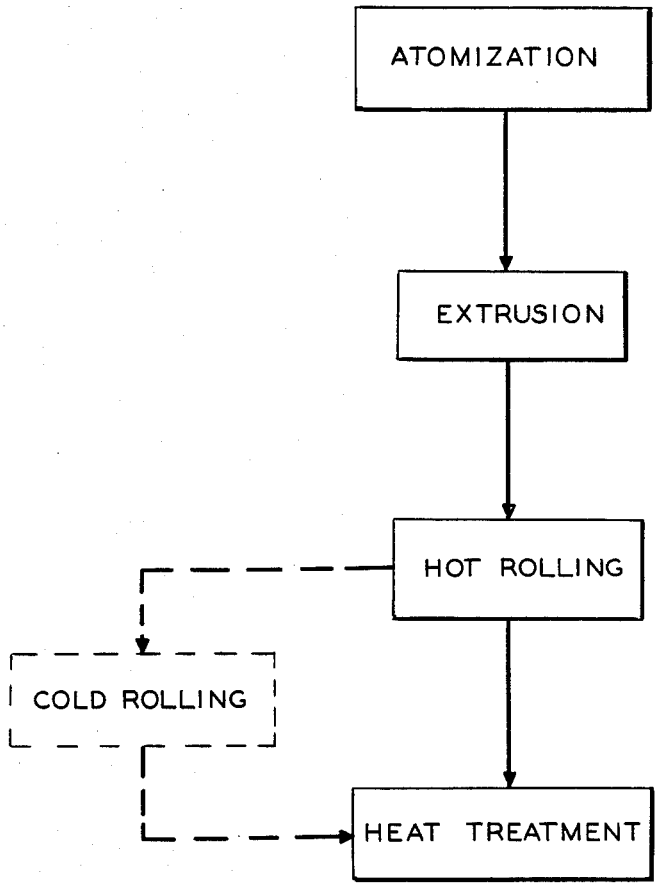
FIG. 1 is a schematic flow chart of the instant invention.

Referring now to FIG. 1, there is shown a schematic flow chart of the instant invention. The appropriate constitutents making up the alloy are water atomized to form a powder. The powder is canned and then extruded. The extruded product is hot rolled in the direction parallel to the extrusion direction. After decanning, the product is recrystallized by annealing. Alternatively, the product may be cold rolled after the hot rolling step and then annealed.

The assignee of the instant invention produces INCOLOY* alloy 800. INCOLOY alloy 800 is a high temperature, conventionally wrought alloy exhibiting good strength and good oxidation and carburization resistance. Its nominal chemical composition (by weight percent) is as follows:

INCOLOY Alloy 800

Nickel 30–35%
Chromium 19–23%
Manganese 0–1.5%
Silicon 0–1%
Aluminum 0.15–0.60%
Titanium 0.14–0.60%
Copper 0–0.75%
Iron-Balance

*Trademark of the Inco family of companies.

It was surmised that by controlling the composition and oxide content (such as $Al_2O_3$ and $Y_2O_3$) of INCOLOY alloy 800 and other alloys, applying water atomization/powder metallurgy techniques thereto and applying suitable thermomechanical processing (TMP) steps, a coarse, elongated grain structure would evolve. The following experimental trials have successfully borne this out.

EXAMPLE 1

Seven heats similar to INCOLOY alloy 800 with various levels of manganese, silicon, aluminum, titanium and yttrium were air induction melted under an argon cover and then water atomized. The melting practice is shown in Table I below. Hereinafter, the instant invention will be referred to as "P/M alloy".

TABLE I

| MELTING PRACTICE FOR P/M ALLOY | |
|---|---|
| Raw Material Charge | |
| Fe-Electrolytic<br>Ni-Pellet<br>Cr-Low C, Vacuum Grade<br>C-Stick | Melt and boil at 1593° C. (2900° F.) for 5 minutes, cool to 1510° C. (2750° F.). |
| ADD DEOXIDIZERS (If Required) | |
| Mn-Electrolytic<br>Si-Metal<br>Al-Rod<br>Ti-Sponge | After additions were melted, hold at 1510° C. (2750° F.) for 2 minutes. |
| ADD INCOCAL* alloy 10 (.05 wt. %) (A nickel/calcium deoxidizer and sulfur scavenger) | |
| ADD YTTRIUM (.05 wt. %) (If Required) | |
| Pour into Preheated Tundish (~1093° C. or ~2000° F.) at 1510° C. (2750° F.) | |
| WATER ATOMIZE | |

*Trademark of the INCO family of companies.

The chemical and screen analysis of the resulting water atomized powder are shown in Tables II and III. Photomicrographs of the powder revealed fine, irregularly shaped particles of various dimensions.

TABLE II

COMPOSITIONS OF THE P/M ALLOY POWDERS (Wt. %)

| Heat No. | Fe | Ni | Cr | Al | Ti | Mn | Si | C | O | N | Y |
|---|---|---|---|---|---|---|---|---|---|---|---|
| A | Bal | 32.2 | 20.3 | .60 | .49 | .76 | .35 | .07 | .08* | .02 | NA |
| B | " | 32.5 | 20.5 | .55 | .50 | NA | NA | .09 | .06* | .02 | NA |
| C | " | 32.9 | 20.9 | .26 | .35 | .85 | .45 | .10 | .39 | .02 | NA |
| D | " | 31.7 | 20.9 | .28 | .37 | NA | NA | .10 | .39 | .05 | NA |
| 1 | " | 33.5 | 20.8 | .11 | .18 | .82 | .40 | .09 | .38 | .05 | NA |
| E | " | 32.0 | 21.2 | .12 | .20 | NA | NA | .07 | .32 | .05 | NA |
| 2 | " | 32.5 | 21.1 | .07 | .15 | .81 | .36 | .10 | .32 | .03 | .036 |

NOTE:
NA = Not Analyzed (no addition was made).
*These levels appear in heats having relatively higher aluminum and titanium levels. One explanation for this anomoly may be due to oxidation occurring essentially on the surface of the oxide forming metals, leaving the interiors virtually unoxidized.

TABLE III

SCREEN ANALYSIS OF THE P/M ALLOY POWDERS

| | Screen Analysis, Mesh Size, (U.S. Standard) % | | | | | |
|---|---|---|---|---|---|---|
| Heat No. | +20 | −20/+60 | −60/+100 | −100/+200 | −200/+325 | −325 |
| A | 1 | 2 | 6 | 30 | 25 | 36 |
| B | 1 | 1 | 5 | 32 | 25 | 36 |
| C | 0 | 1 | 4 | 31 | 27 | 37 |
| D | 0 | 1 | 3 | 24 | 33 | 39 |
| 1 | 0 | 1 | 4 | 28 | 35 | 32 |
| E | 0 | 1 | 4 | 27 | 34 | 34 |
| 2 | 0 | 1 | 4 | 30 | 29 | 36 |

After screening to remove the coarse +40 mesh particles, the as-atomized powders of each heat were packed into mild steel extrusion cans, which were then evacuated at 816° C. (1500° F.) for approximately three hours, and then sealed. Three additional cans from heats 2, B, and C (designated 2-W, B-W, C-W) were sealed in air for comparison purposes as discussed hereinafter. The extrusion conditions are summarized in Table IV, including extrusion temperatures, extrusion ratio, throttle and lubrication. Portions of each heat were extruded under the four different extrusion conditions set forth in Table IV. Bars from the low extrusion ratio measured 50.8 mm×19.0 mm (2 in×$\frac{3}{4}$ in). The high extrusion ratio produced bars 34.9 mm×19.0 mm ($1\frac{3}{8}$ in×$\frac{3}{4}$ in). These dimensions include the mild steel can material.

TABLE IV

EXTRUSION CONDITIONS OF THE P/M ALLOY

| Extrusion Temperature | | | Nominal Extruded Bar Size | |
|---|---|---|---|---|
| °C. | (°F.) | Extrusion Ratio | mm | (in) |
| 1010 | 1850 | ~8:1 | 50.8 × 19 | (2 × $\frac{3}{4}$) |
| 1010 | 1850 | ~15:1 | 34.9 × 19 | ($1\frac{3}{8}$ × $\frac{3}{4}$) |
| 1066 | 1950 | ~8:1 | 50.8 × 19 | (2 × $\frac{3}{4}$) |
| 1066 | 1950 | ~15:1 | 34.9 × 19 | ($1\frac{3}{8}$× $\frac{3}{4}$) |

NOTES:
1. Cans were heated 3 hours at extrusion temperature prior to extrusion.
2. Lubrication was provided by a glass pad on the die face with oil in the extrusion chamber and a glass wrap on the heated can.
3. Throttle was set to 30%.
4. The extrusion ratio was calculated without considering the dimensions of the can. Alternatively, if the can is taken into account, the ratio would be somewhat lower (~7:1 and ~10:1).

Each extruded bar was cut into three sections and hot rolled parallel to the extrusion direction at three different temperatures—988°, 954° and 1037° C. (1450°, 1750° and 1900° F.)—after preheating one hour at the rolling temperature. Both low and high extrusion ratio bars were rolled from 19 mm (0.75 in) using two passes: 13 mm (0.5 in) and then 10 mm (0.375 in) without reheat. No problem was experienced during the thermomechanical processing step. The rolled bars were then sand-blasted and pickled to remove the can material.

All the decanned bars were given a recrystallization anneal at 1316° C. (2400° F.) under argon for $\frac{1}{2}$ hour and air cooled.

Round bars 3.5 mm (0.138 in) diameter by 19.05 mm (0.75 in) gage length for tensile and stress rupture tests were machined in both longitudinal and transverse orientations from the annealed bars that exhibited a coarse grained directional microstructure. Tensile tests were performed both at room and elevated temperatures—871°, 982° and 1093° C. (1600°, 1800° and 2000° F.). The stress rupture tests were performed at the same temperatures.

Oxidation resistance was measured at 1100° C. (2012° F.) for 504 hours. The test was cyclic in nature with the specimens being cooled rapidly to room temperature and weighed daily. The environment was low velocity air with 5% $H_2O$. After final weight measurements, the samples were descaled by a light $Al_2O_3$ grit blast and the descaled weight was measured.

The sulfidation resistance screening test was conducted at 982° C. (1800° F.). The test was also cyclic in nature with specimens being cooled rapidly to room temperature and weighed daily. The environment was $H_2$ with 45% $CO_2$ and 1.0% $H_2S$ at gas flow rate of 500 $cm^3$/min. The first cycle of the test was run with no $H_2S$ to oxidize the sample surface. The test was stopped when specimens were seriously corroded at the end of a cycle.

The effects of chemical composition on microstructure are shown in Table V below. Table V exhibits the results of a preferred embodiment of the invention.

TABLE V

EFFECT OF CHEMICAL COMPOSITION ON MICROSTRUCTURE

| Heat No. | Composition Variant (wt. %) Al,Ti | Mn,Si | $O_2$ | Y | Microstructure |
|---|---|---|---|---|---|
| A | .60,.49 | .76,.35 | .08 | None | Fine equiaxed |
| B | .55,.50 | None | .06 | " | Fine equiaxed |
| C | .26,.35 | .85,.45 | .39 | " | Coarse elongated, equiaxed |
| D | .28,.27 | None | .39 | " | Equiaxed |
| 1 | .11,.18 | .82,.40 | .38 | " | Coarse, elongated |
| E | .12,.20 | None | .32 | " | Equiaxed |
| 2 | .07,.15 | .81,.36 | .32 | .036 | Coarse, elongated |

NOTE:
Processing Conditions: Extruded at 1066° C. (1950° F.), 8:1 ratio, hot rolled at 788° C. (1450°F.) and annealed at ½ hr 1316° C. (2400° F.) and air cooled.

Coarse, elongated grain structures with occasional stringers and many finely dispersed particles were obtained in heats 1 and 2 for the TMP combination with the lower extrusion ratio (8:1), the higher extrusion temperature of 1066° C. (1950° F.), and the lowest rolling temperature of 788° C. (1450° F.). Heat 2 had virtually the same composition as heat 1 (i.e., both heats have low levels of Al and Ti, and contain a presence of Mn and Si) aside from the 0.036 wt.% Y addition. Heat C had slightly higher Al and Ti levels than heat 1 but it developed a coarse elongated grain structure only in the ends of the hot rolled and annealed bars. The center portion of this bar revealed equiaxed grain structure similar to that seen in the conventionally wrought INCOLOY alloy 800. An equiaxed grain structure was obtained in heat D which has comparable chemical composition to heat C, but without Mn and Si. The remaining two heats (A and B), having high Al and Ti levels and lower $O_2$ levels (0.06–0.08 wt.%) showed a very fine equiaxed grain structure.

The above results indicate that the combined presence of Mn and Si, lower Al and Ti, plus higher $O_2$ level (0.32–0.38 wt.%) contribute to the directional grain growth.

The grain structure varied from fine equiaxed to coarse elongated with various rolling temperatures on heat 2. The route yielding the desired coarse elongated grain structure was again, the TMP combination of lowest extrusion ratio (8:1), the higher extrusion temperature of 1066° C. (1950° F.), and lowest rolling temperature of 788° C. (1450° F.). In other words, the lower extrusion temperature and higher extrusion ratio and rolling temperatures have the tendency to produce finer equiaxed grain structure. Typically, two to six grains appear across the thickness of the longitudinal section (6.4 mm, ¼ in) of those hot rolled plates exhibiting coarse elongated grain structure. No significant grain structure difference was observed in longitudinal and transverse directions, i.e., the grain shape was plate-like rather than rod shaped. The grain aspect ratio is generally greater than 10:1 in the longitudinal direction.

Transmission election microscopy foils were prepared from the hot rolled and annealed bars of heats 1 and 2 to determine the dispersoid distribution in the coarse elongated grain structure. Dislocations tangled with inclusions were present in the microstructure. However, besides the dislocations, the twin density of heat 2 appears to be higher than that of heat 1. The angular inclusions which are also seen in INCOLOY alloy 800 have been identified as titanium rich, while the small particles observed in heats 1 and 2, which were too small for quantitative analysis, are probably a combination of oxides, including $Al_2O_3$, $TiO_2$, and/or $Y_2O_3$. This trace of fine particle dispersion in the P/M alloy appears to be less uniform than that of the oxide dispersion strengthened alloys produced by mechanical methods.

Three annealed bars, one from heat 1 and two from heat 2 (one was from the nonevacuated extruded can) of the P/M alloy exhibited the coarse-directional grain structure. Mechanical property evaluations were performed on these three bars.

Figure 2:
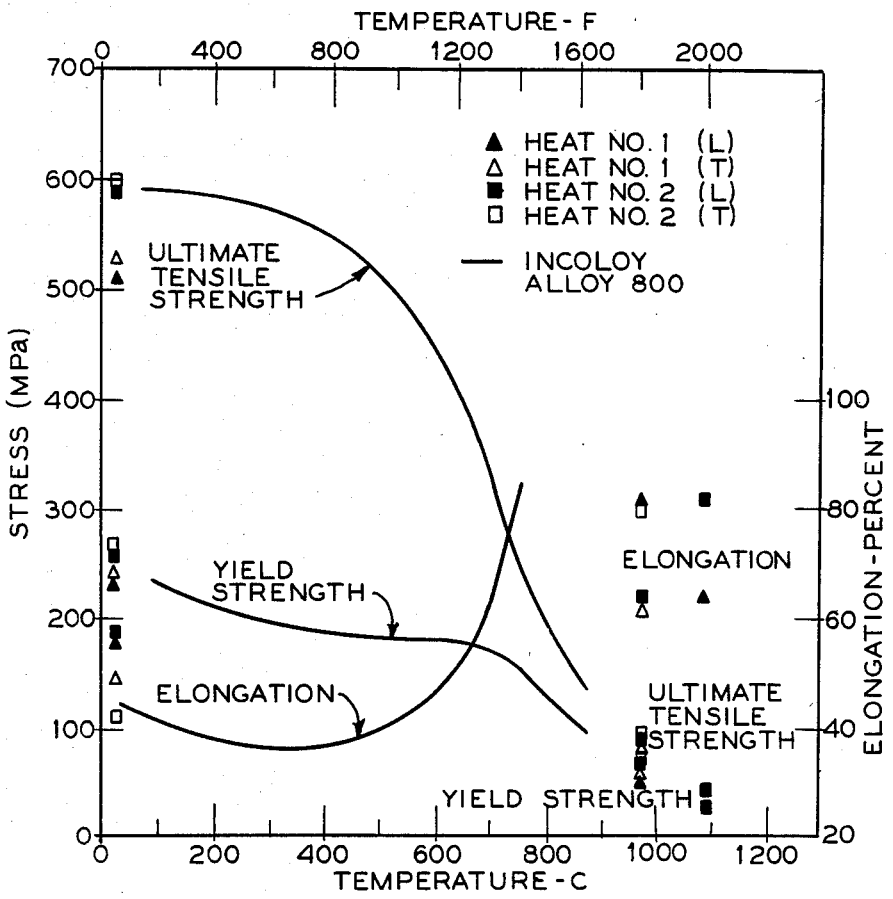
FIG. 2 compares the tensile properties of the instant invention with an existing conventionally wrought alloy.

Tensile Properties. The room and elevated temperature tensile properties of the P/M alloy, along with the tensile properties of INCOLOY alloy 800 are listed in Table VI and plotted in FIG. 2. Results indicate that P/M alloy has tensile elongation (40–80%), and tensile strength comparable to that of INCOLOY alloy 800 at both room temperature and elevated temperatures. Heat 2 is somewhat stronger than heat 1. This is believed to be caused by the yttrium oxide present in heat 2.

Stress Rupture Properties. Table VII presents the longitudinal and transverse stress rupture properties of the P/M alloy. For both heats of 1 and 2, the longitudinal rupture strength is slightly higher than the transverse rupture strength. In general, heat 2 is slightly stronger than heat 1. The rupture ductility of the P/M alloy, which ranges from 10–40%, is comparable to that of conventionally wrought alloys.

Figure 3:
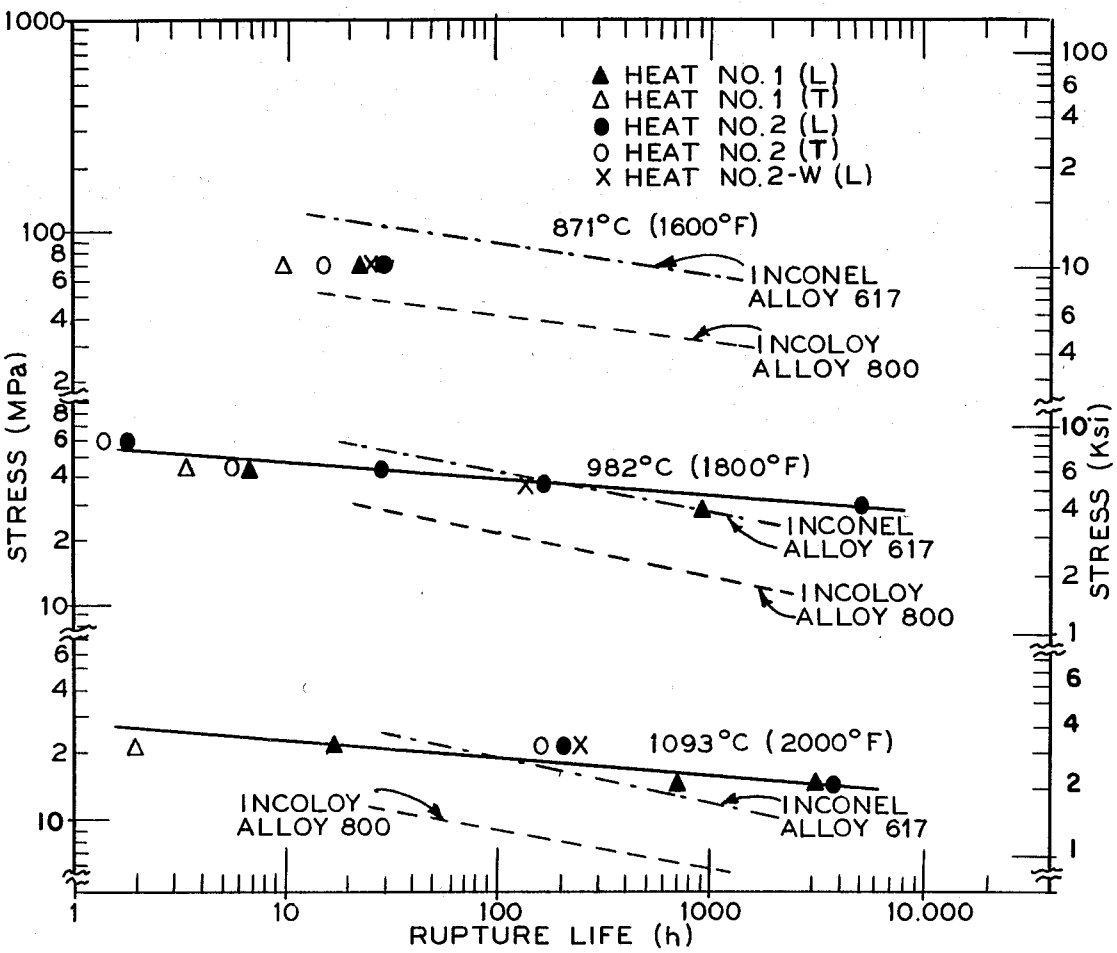
FIG. 3 compares the stress rupture properties of the instant invention with two existing conventionally wrought alloys.
Figure 4:
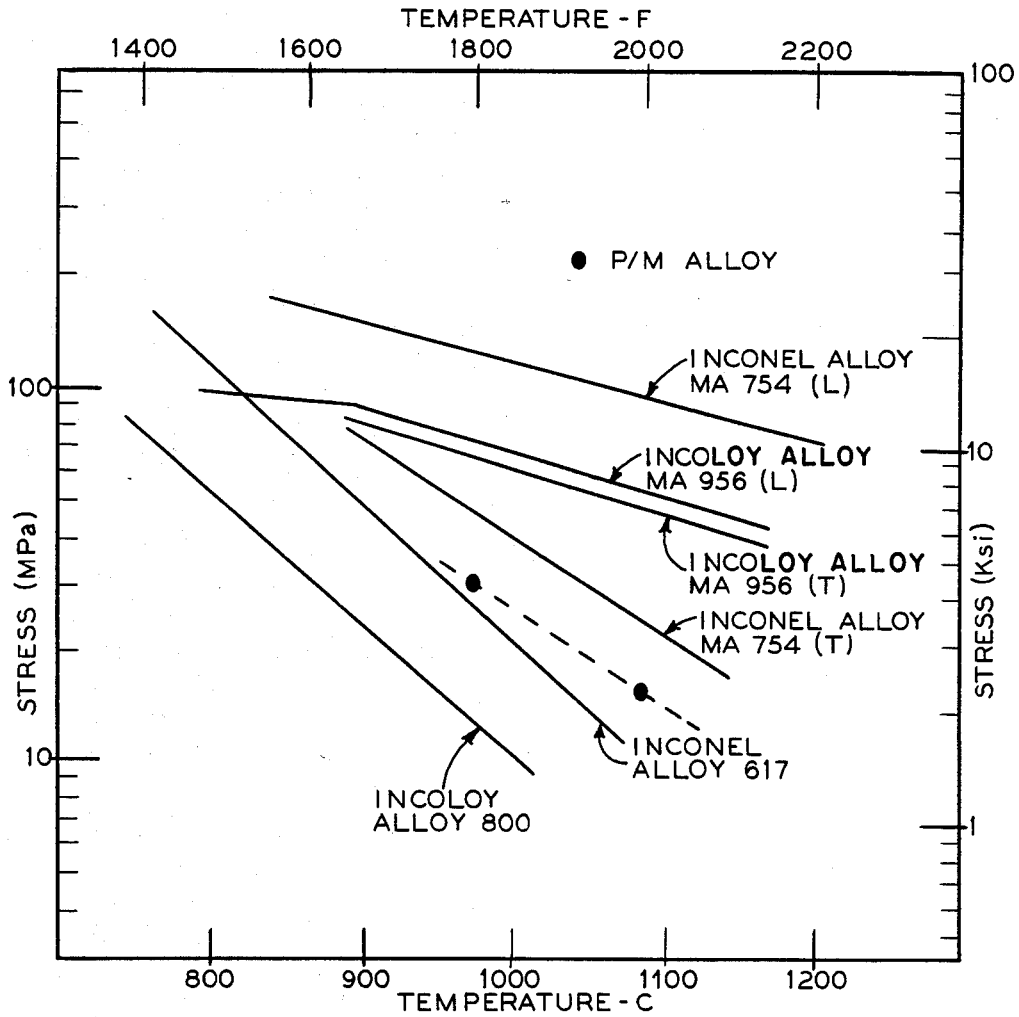
FIG. 4 compares one thousand hour stress rupture properties of the instant invention with two conventionally wrought alloys and two mechanically alloyed materials.

The stress rupture data of the P/M alloy, along with the rupture data of INCOLNEL* alloy 617 and INCOLOY alloy 800 for comparison purposes are shown in FIG. 3. The limited 871° C. (1600° F.) data indicate that the P/M alloy is stronger than INCOLOY alloy 800 but weaker than INCONEL alloy 617. At 982° C. (1800° F.), the P/M alloy is not only stronger than INCOLOY alloy 800 but also stronger than INCONEL alloy 617 at lives greater than 500 hours. As the test temperature increases to 1093° C. (2000° F.), the P/M alloy is much superior to INCOLOY alloy 800 and stronger than INCONEL alloy 617 at lives greater than 100 hours. The slopes of the rupture curves in FIG. 4 indicate that the dependence of the P/M alloy rupture life on applied stress, i.e., the stress exponent, is much higher than the corresponding stress exponent for conventionally wrought alloys. A plot of 1000-hour stress rupture strength of P/M alloy, along with INCOLOY alloy 800, INCONEL alloy 617 and mechanically alloyed alloys (INCONEL alloy MA 754 and INCOLOY alloy MA 956) is shown in FIG. 4. It is apparent tha the rupture strength of P/M alloy is greater than conventional wrought alloys but less than mechanically alloyed alloys at high temperatures [>982° C.(1800° F.)].

*Trademark of the Inco family of companies.

TABLE VI

TENSILE PROPERTIES OF P/M ALLOY

| Alloy | Heat No. | Orientation | YS MPa | YS (ksi) | UTS MPa | UTS (ksi) | El. (%) | RA (%) |
|---|---|---|---|---|---|---|---|---|
| | | Room Temperature | | | | | | |
| P/M alloy | 1 | L | 231.3 | (33.6) | 510.9 | (74.1) | 56.5 | 41.5 |
| " | 1 | T | 238.6 | (34.7) | 526.1 | (76.3) | 49.0 | 36.0 |
| " | 2 | L | 253.7 | (36.8) | 581.9 | (84.4) | 58.0 | 45.5 |
| " | 2 | T | 265.5 | (38.5) | 595.0 | (86.3) | 42.0 | 38.0 |
| " | 2-W(1) | L | 250.3 | (36.3) | 553.0 | (80.2) | 44.0 | 42.5 |
| INCOLOY alloy 800 | — | — | 250.0 | (36.0) | 595.0 | (86.0) | 44.0 | — |
| | | 982° C. (1800° F.) | | | | | | |
| P/M alloy | 1 | L | 56.5 | (8.2) | 74.5 | (10.8) | 82.0 | 66.5 |
| " | 1 | T | 64.8 | (9.4) | 87.6 | (12.7) | 51.0 | 45.0 |
| " | 2 | L | 66.2 | (9.6) | 86.9 | (12.6) | 63.5 | 70.5 |
| "2 | T | 72.4 | (10.5) | 88.3 | (12.3) | 80.0 | 56.0 | |
| " | 2-W(1) | L | 70.3 | (10.2) | 92.4 | (13.4) | 69.0 | 66.5 |
| | | 1093° C. (2000° F.) | | | | | | |
| P/M alloy | 1 | L | 34.5 | (5.0) | 48.3 | (7.0) | 63.5 | 66.6 |
| " | 2 | L | 36.5 | (5.3) | 49.0 | (7.1) | 82.0 | 75.0 |
| " | 2-W(1) | L | 40.7 | (5.9) | 52.4 | (7.6) | 54.5 | 76.5 |

Notes:
(1)No evacuation was performed on the extrusion can.
L = Longitudinal
T = Transverse

TABLE VII

STRESS RUPTURE PROPERTIES OF THE P/M ALLOY

| Heat No. | Orientation | Stress MPa | Stress (ksi) | Life (h) | El. (%) | RA (%) |
|---|---|---|---|---|---|---|
| | | 871° C. (1600° F.) | | | | |
| 1 | L | 69.0 | (10) | 23.2 | 37.5 | 51.7 |
| 1 | T | 69.0 | (10) | 10.3 | 10.0 | 36.0 |
| 2 | T | 69.0 | (10) | 16.7 | 17.5 | 39.6 |
| 2-W(1) | L | 69.0 | (10) | 29.8 | 11.7 | 35.6 |
| | | 982° C. (1800° F.) | | | | |
| 1 | L | 27.6 | (4) | 957.2 | 16.3 | 54.9 |
| 1 | L | 41.4 | (6) | 6.8 | 13.8 | 21.0 |
| 1 | T | 41.4 | (6) | 3.5 | 20.6 | 44.0 |
| 1 | L | 51.7 | (7.5) | 0.6 | 40.0 | 74.1 |
| 1 | T | 51.7 | (7.5) | 0.6 | 30.0 | (2) |
| 2 | L | 27.6 | (4) | 5500.0(3) | — | — |
| 2 | L | 20.7 | (3) | 1464.0(4) | — | — |
| 2 | L | 34.5 | (5) | 177.2 | 25.0 | 57.5 |
| 2-W(1) | L | 34.5 | (5) | 167.8 | 13.2 | 55.3 |
| 2 | L | 41.4 | (6) | 29.0 | 19.8 | 15.4 |
| 2 | T | 41.4 | (6) | 6.2 | 15.6 | 17.2 |
| 2 | L | 55.2 | (8) | 1.9 | 38.8 | 67.2 |
| 2 | T | 55.2 | (8) | 1.5 | 25.0 | 42.6 |
| | | 1093° C.(2000° F.) | | | | |
| 1 | L | 13.8 | (2) | 3609.3 | 15.1 | 21.5 |
| 1 | T | 13.8 | (2) | 751.3 | — | — |
| 1 | T | 20.7 | (3) | 17.6 | 11.8 | 69.7 |
| 1 | T | 20.7 | (3) | 2.1 | 17.3 | 35.9 |
| 2 | L | 13.8 | (2) | 3990.0(3) | — | — |
| 2 | L | 20.7 | (3) | 222.3 | 13.5 | 66.7 |
| 2 | T | 20.7 | (3) | 162.5 | 6.7 | 34.6 |
| 2-W(1) | L | 20.7 | (3) | 251.1 | 11.1 | 14.8 |

NOTES:
(1)No evacuation during can preparation.
(2)Sample split.
(3)Test stopped before failure.
(4)Step loaded from 20.7 MPa to 34.5 MPa at 1464 hour.
L = Longitudinal
T = Transverse Results obtained in a related test program indicated that can evacuation does not improve properties. To test this behavior for the P/M alloy, three additional cans from heats 2, B and C were prepared with no evacuation and then processed according to the thermomechanical processing previously described. The effects of chemical composition on microstructure of the evacuated material were also found to be similar for the material with no evacuation treatment. Therefore, hot rolled bar of heat 2 (designated 2-W) was the only material exhibiting coarse elongated grain structure after final annealing. Chemical analysis indicated that there was no significant difference in oxygen and nitrogen levels for the materials with and without evacuation treatment. The limited tensile and rupture properties of material with no evacuation treatment (2-W) given in Tables VI and VII and plotted in FIG. 3 are similar to those for evacuated material (heat 2).

Cyclic oxidation and hot corrosion (sulfidation) tests were run on both the P/M alloy and INCOLOY alloy 800. The oxidation and sulfidation resistance results are given in Tables VIII and IX, respectively.

TABLE VIII

CYCLIC OXIDATION TEST RESULTS

| Alloy | Heat No. | Weight Change ($kg/m^2$) Undescaled | Weight Change ($kg/m^2$) Descaled |
|---|---|---|---|
| P/M alloy | 1 | −1.60 | −3.32 |
| P/M alloy | 2 | −0.95* | −2.04* |
| INCOLOY alloy 800 | — | −1.67 | −3.77 |

*Average of two duplicate tests.
NOTE:
Conditions:
1100° C. (2012° F.), air + 5% $H_2O$ flowing at 500 $cm^3$/min, 504 hours. Sample cycled to room temperature every 24 hours.

TABLE IX

SULFIDATION TEST RESULTS

| Alloy | Heat No. | Time of Failure (hrs.) | Undescaled Weight Change After 120-Hour Test ($kg/m^2$) |
|---|---|---|---|
| P/M alloy | 1 | 264 | 0.076 |
| P/M alloy | 2 | 120 | 0.307 |
| INCOLOY alloy 800 | — | 120 | 0.155 |

NOTE:
Conditions:
982° C. (1800° F.), $H_2$-45$CO_2$-1.$OH_2S$. No $H_2S$ in the first cycle. Sample cycled to room temperature every 24 hours.

As seen in Table VIII, it is evident that the P/M alloy has slightly better oxidation resistance than INCOLOY alloy 800. Results also indicate that the oxidation resistance may be improved with small addition of yttrium in the P/M alloy. As shown in Table IX, the P/M alloy is comparable to INCOLOY alloy 800 in hot corrosion.

In order to determine the effect of cold rolling on the P/M alloy, a portion of heat 2 was processed in a similar manner under somewhat higher consolidation temperatures. The can was extruded at 1121° C. (2050° F.) and hot rolled at 954° C. (1750° F.). After decanning, the resulting product was cold rolled twenty percent and then heat treated at 1316° C. (2400° F.) for one hour under argon. The product also displayed the desired coarse, elongated grain structure.

EXAMPLE 2

A second set of heats, utilizing virtually the same parameters and conditions as disclosed in Example 1, were produced to ascertain the resulting microstructure and determine whether the coarse elongated grain structure would reappear. A minor difference was that a slightly coarser powder was produced due to the use of a slightly larger water atomizer jet. This distinction, however, does not appear to have affected the results in any measurable way.

The chemical composition and resulting microstructure response are given in Table X. The screen analysis of these powders is given in Table XI.

TABLE X

| | COMPOSITION OF P/M ALLOY POWDERS (WT. %) | | | | | | | | | | | |
|---|---|---|---|---|---|---|---|---|---|---|---|---|
| Heat No. | Fe | Ni | Cr | Al | Ti | Mn | Si | C | O | N | Y | Microstructure Response |
| 3 | Bal | 32.5 | 21.0 | 0.25 | 0.18 | 0.83 | 0.42 | 0.086 | 0.32 | 0.034 | — | Coarse, elongated |
| 4 | Bal | 32.3 | 21.0 | 0.13 | 0.19 | 0.81 | 0.42 | 0.068 | 0.38 | 0.030 | 0.031 | Coarse, elongated |
| F | Bal | 33.1 | 20.6 | 0.56 | 0.48 | 0.82 | 0.43 | 0.066 | 0.23 | 0.024 | 0.025 | Fine, equiaxed |
| G | Bal | 32.7 | 20.9 | 0.64 | 0.43 | 0.78 | 0.42 | 0.10 | 0.17 | 0.026 | — | Fine, equiaxed |
| 5 | Bal | 32.4 | 21.0 | 0.11 | 0.19 | 0.50 | 0.25 | 0.09 | 0.27 | 0.039 | — | Coarse, elongated |
| H | Bal | 32.5 | 20.8 | 0.63 | 0.53 | 0.44 | 0.25 | 0.088 | 0.20 | 0.021 | — | Fine, equiaxed |

TABLE XI

| | SCREEN ANALYSIS OF P/M ALLOY POWDERS Screen Analysis, Mesh Size, (U.S. Standard) % | | | | | |
|---|---|---|---|---|---|---|
| Heat No. | +20 | −20/+60 | −60/+100 | −100/+200 | −200/+325 | −325 |
| 3 | 0.20 | 5.83 | 31.70 | 46.67 | 8.95 | 6.65 |
| 4 | 0.20 | 7.82 | 32.33 | 41.58 | 8.44 | 9.63 |
| F | 0.11 | 2.69 | 22.47 | 49.84 | 13.76 | 11.13 |
| G | 0.10 | 1.60 | 17.89 | 50.68 | 15.95 | 13.78 |
| 5 | 0.18 | 1.29 | 13.63 | 48.04 | 18.11 | 18.75 |
| H | 2.92 | 6.30 | 17.90 | 40.85 | 14.88 | 17.55 |

Heats 3, 4 and 5 displayed the desired coarse, elongated microstructure. As before, higher oxygen content and lower aluminum and titanium levels appear to produce the desired results when in combination with the instant TMP. It would appear that aluminum and titanium levels should be kept below 0.3% each. Moreover, it is believed that titanium levels may be eliminated entirely.

EXAMPLE 3

In view of the outstanding results achieved above, a trial was conducted on a different alloy system, HASTELLOY* alloy X, to determine the efficacy of the instant invention. As will be seen below, the results were encouraging.

The nominal chemical composition (in weight percent) of HASTELLOY alloy X (designated P/M alloy X) sample used was:

| | Sample | (Published Range) |
|---|---|---|
| Nickel | Balance | Balance |
| Chromium | 21.7 | 20.5–23.0 |
| Iron | 18.8 | 17–20 |
| Molybdenum | 9.1 | 8–10 |
| Cobalt | 1.6 | 0.5–2.5 |

-continued

| | Sample | (Published Range) |
|---|---|---|
| Manganese | .46 | |
| Silicon | .44 | |
| Oxygen | .32 | |
| Aluminum | .13 | |
| Carbon | .055 | .05–.20 |
| Nitrogen | .038 | |
| W | .39 | 0.2–1.0 |

*Trademark of Cabot Corporation

*Trademark of Cabot Corporation

As before, the elemental constituents were water atomized, consolidated and extruded. Extrusion occurred at 1066° C. (1950° F.); the extrusion ratio was about 8:1 and the bar size was about 50.8×19 mm (2×0.75 in). The bar was then hot rolled at 1066° C. (1950° F.) in two passes from 13 mm (0.5 in) to 10 mm (0.375 in). After decanning, the bar was annealed at 1260° C. (2300° F.) for one half hour. Analysis again showed the desired coarse, elongated grain structure.

The tensile properties of the P/M alloy X and conventional HASTELLOY alloy X are shown in Table XII. From the data it appears that the tensile properties of the two alloys are approximately equivalent.

TABLE XII

| TENSILE PROPERTIES OF P/M ALLOY X AND CONVENTIONAL HASTELLOY ALLOY X | | | | | | |
|---|---|---|---|---|---|---|
| | Y.S. | | U.T.S. | | El. | RA |
| Alloy | MPa | (ksi) | MPa | (ksi) | (%) | (%) |
| Room Temperature | | | | | | |
| P/M Alloy X | 323 | (46.9) | 632 | (91.7) | 42.0 | 31.0 |
| Conventional HASTELLOY Alloy X | 359 | (52.0) | 786 | (114.0) | 43.0 | — |
| 982° C. (1800° F.) | | | | | | |
| P/M Alloy X | 102 | (14.8) | 130 | (18.8) | 52.0 | 62.0 |
| Conventional HASTELLOY Alloy X | 110 | (16.0) | 152 | (22.0) | 45.0 | — |
| 1093° C. (2000° F.) | | | | | | |
| P/M Alloy X | 46 | (6.7) | 72 | (10.4) | 22.0 | 18.0 |
| Conventional HASTELLOY Alloy X | 55 | (8.0) | 90 | (13.0) | 40.0 | — |

NOTE:
MPa are approximate.

The stress rupture properties of the P/M alloy X and conventional HASTELLOY alloy X are shown in Table XIII. From the data, it appears that the stress rupture properties of P/M alloy X are superior to those of conventional HASTELLOY alloy X.

TABLE XIII

STRESS RUPTURE PROPERTIES OF P/M ALLOY X AND CONVENTIONAL HASTELLOY ALLOY X

| Alloy | Temperature °C. | (°F.) | Stress MPa | (ksi) | Life (h) |
|---|---|---|---|---|---|
| P/M Alloy X | 982 | (1800) | 28 | (4) | 827.3 |
| Conventional HASTELLOY ALLOY X | 982 | (1800) | 28 | (4) | 90.0 |
| P/M Alloy X | 1093 | (2000) | 34 | (5) | 102.4 |
| | | | 28 | (4) | 71.9 |
| Conventional HASTELLOY Alloy X | 1093 | (2000) | 28 | (4) | 2 |

NOTE:
MPa are approximate.

In an attempt to explore the mechanism responsible for the development of coarse, elongated grain growth in such alloys, the following theory is proposed. During water atomization the alloy powder becomes oxidized, (the oxygen supplied by the water) with traces of stable oxides such as alumina and titanium oxide and unstable oxides, such as nickel oxide, manganese oxide, silicon oxide and chromium forming. During the subsequent thermomechanical processing steps, these oxides become fairly evenly distributed throughout the alloy matrix. These oxides may tend to inhibit the dynamic recovery or recrystallization that would normally be expected to occur during the processing of "cleaner" alloy types such as conventionally cast and wrought alloys or inert gas atomized powder alloys. The resulting water atomized, consolidated and worked bars are believed, prior to annealing, to have a fine grain size, and are in an energy state that favors recrystallization into coarse grains when heated to a high enough temperature. Additionally, the dispersed oxides tend to inhibit recrystallization during annealing until the grain boundaries attain sufficient thermal energy (that is, high enough temperature) to bypass them. Also, unidirectional working appears to tend to string out the oxides in the direction of working, preventing grain growth in the direction perpendicular to the working direction, therefore resulting in a coarse, elongated grain structure. The resulting single phase, austenitic alloy displays no $\gamma'$ (gamma prime).

Both the low and high deoxidized atomized powders probably contain the unstable oxides and stable oxides on the surface of the powders. Subsequent pre-extrusion heat treatment of high deoxidized materials (such as heats A and B) may cause diffusion of unreacted deoxidants to the powder surface where additional stable oxides (such as $Al_2O_3$ and $TiO_2$) form. For the low deoxidation powders, little Al and Ti elements remain in solution so the initially formed surface oxides remain. On processing, the stable oxides formed in the high deoxidized heat act as grain boundary pinning points causing the fine grained structure. The powder surface oxides of the low Al+Ti alloys (heats 1-5) are less stable and coalesce during controlled thermomechanical processing permitting a coarse elongated grain after a final annealing (at about 1316° C. or 2400° F.—about 37° C. or 100° F. below the melting temperature).

If the inventors may be permitted to wax poetic, the coarsening and elongating action may be explained by the "Critical Dirt Level Theory". The theory contains two legs: (1) A critical level of oxide or oxygen impurities ("dirt") within the heat. If there is an insufficient quantity of oxide, there are not enough barrier sites to impede normal dynamic recrystallization. There is an insufficient driving force to grow new grains. Conversely, if there is too much oxide, there are too many barriers that will interfere with elongated grain coarsening.

At the critical dirt level (or range) and at appropriately high temperatures, the grain boundaries will be able to bypass the oxides and recrystallize in an elongated manner. Normal ingot metallurgy or gas atomization practice may simply be too "clean" to encourage coarse, elongated grains.

(2) Deformation imparted by the thermomechanical process operations appears to favor the growth of the fewer grains. The resulting grains that do appear are elongated.

Accordingly, the two mechanisms (oxide impurities and deformation) appear to coalesce in a synergistic manner to egender a coarse, elongated grain structure in alloys.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privelege is claimed are defined as follows:

1. A method of making alloys characterized by a coarse, elongated grain structure, the method comprising:

(a) water atomizing a charge of components comprising the alloy to form powder, (b) extruding the powder to a predetermined product configuration, (c) hot rolling the product in a direction substantially parallel to the extrusion direction and, (d) annealing the product to permit recrystallization therein.

2. The method according to claim 1 wherein oxygen is introduced into the alloy during water atomization.

3. The method according to claim 1 wherein the alloy consists essentially of about 30-35% nickel, about 19-23% chromium, up to about 1.5% manganese, up to about 1% silicon, about 0.07-0.60% aluminum, about 0.14-0.6% titanium, about 0.27-0.38% oxygen, up to about 0.75% copper, up to about 0.036% yttrium, and the balance iron.

4. The method according to claim 3 wherein the alloy consists essentially of about 32.3-33.5% nickel, about 20.8-21.1% chronium, about 0.07-0.60% aluminum, about 0.15-0.19% titanium, about 0.50-0.83% manganese, about 0.25-0.42% silicon, about 0.068-0.10% carbon, about 0.27-0.38% oxygen, about 0.03-0.05% nitrogen, about 0.031-0.036% yttrium, and the balance iron.

5. The method according to claim 1 wherein the alloy consists essentially of about 20.5-23.0% chromium, about 17-20% iron, about 8-10% molybdenum, about 0.5-2.5% cobalt, about 0.05-0.20% carbon, about 0.2-1.0% tungsten, and the balance nickel.

6. The method according to claim 1 wherein oxides selected from the group consisting of alumina, manganese oxide, silicon oxide and titanium oxide are present in the alloy.

7. The method according to claim 1 wherein the extrusion ratio is about 8:1.

8. The method according to claim 1 wherein extrusion is conducted at about 1066° C.

9. The method according to claim 1 wherein hot rolling is conducted at about 788° C.

10. The method according to claim 1 wherein annealing is conducted at about 1316° C. for about ½ hour.

11. The method according to claim 1 wherein the product is cold rolled prior to annealing.

12. The method according to claim 1 wherein the alloy has a grain aspect ratio greater than about 1:1.

13. The method according to claim 12 wherein the alloy has a grain aspect ratio equal to or greater than 10:1.

14. The method according to claim 1 wherein two to six coarse, elongated grains appear across a 6.4 mm longitudinal section of the product.

15. An article of manufacture made in accordance with claim 1.

16. An alloy, the alloy comprising coarse, elongated grain structure, the grains having an aspect ratio greater than about 1:1, two to six coarse grains appearing across a 6.4 mm longitudinal section of the alloy, the alloy prepared by a method comprising the steps of:

(a) water atomizing a charge of components comprising the alloy to form powder, (b) extruding the powder to a predetermined product configuration, (c) hot rolling the product in a direction substantially parallel to the extrusion direction and, (d) annealing the product to permit recrystallization therein.

17. The alloy of claim 16 wherein oxygen is introduced into the alloy during water atomization.

18. The alloy of claim 16 wherein the alloy consists essentially of about 30–35% nickel, about 19–23% chromium, up to about 1.5% manganese, up to about 1% silicon, about 0.07–0.60% aluminum, about 0.14–0.6% titanium, about 0.27–0.38% oxygen, up to about 0.75% copper, up to about 0.036% yttrium and the balance iron.

19. The alloy of claim 18 wherein the alloy consists essentially of about 32.3–33.5% nickel, about 20.3–21.1% chromium, about 0.07–0.60% aluminum, about 0.15–0.19% titanium, about 0.50–0.83% manganese, about 0.25–0.42% silicon, about 0.068–0.10% carbon, about 0.27–0.38% oxygen, about 0.03–0.05% nitrogen, about 0.031–0.036% yttrium and the balance iron.

20. The alloy according to claim 16 wherein the alloy consists essentially of about 20.5–23.0% chromium, about 17–20% iron, about 8–10% molybdenum, about 0.5–2.5% cobalt, about 0.05–0.20% carbon, about 0.2–1.0% tungsten, and the balance nickel.

21. The alloy of claim 16 wherein oxides selected from the group consisting of alumina, manganese oxide, silicon oxide and titanium oxide are present in the superalloy.

22. The alloy according to claim 16 wherein the extrusion ratio is about 8:1.

23. The alloy according to claim 16 wherein extrusion is conducted at about 1066° C.

24. The alloy according to claim 16 wherein hot rolling is conducted at about 788° C.

25. The alloy according to claim 16 wherein annealing is conducted at about 1316° C. for about ½ hour.

26. The alloy according to claim 16 wherein the product is cold rolled prior to annealing.

27. The alloy according to claim 16 wherein the alloy has a grain aspect ratio equal to or greater than 10:1.

28. An article of manufacture made in accordance with claim 16.

* * * * *